US009413110B1

(12) United States Patent
Liu

(10) Patent No.: US 9,413,110 B1
(45) Date of Patent: Aug. 9, 2016

(54) EMBEDDED SHORT LEAF-SPRING-EQUIPPED CRYSTAL HEAD AND EXTRACTOR THEREOF

(71) Applicant: Chao-Chieh Liu, Taipei (TW)

(72) Inventor: Chao-Chieh Liu, Taipei (TW)

( * ) Notice: Subject to any disclaimer, the term of this patent is extended or adjusted under 35 U.S.C. 154(b) by 0 days.

(21) Appl. No.: 14/793,756

(22) Filed: Jul. 8, 2015

(51) Int. Cl.
*H01R 13/44* (2006.01)
*H01R 13/639* (2006.01)
*H01R 24/60* (2011.01)

(52) U.S. Cl.
CPC ..... *H01R 13/639* (2013.01); *H01R 24/60* (2013.01)

(58) Field of Classification Search
CPC ..... H01R 13/6397; H01R 23/025
USPC ..... 439/133, 676, 541.5, 353
See application file for complete search history.

(56) References Cited

U.S. PATENT DOCUMENTS

2009/0318004 A1* 12/2009 Cours ..... H01R 13/5219 439/304

* cited by examiner

*Primary Examiner* — Phuongchi T Nguyen

(57) ABSTRACT

An embedded short leaf-spring-equipped crystal head includes a crystal head body insertable into a base slot of a base and a leaf spring disposed above the crystal head body to fasten the crystal head body to the base, characterized in that a length of the leaf spring is less than or equal to a length of the base slot. The length of the leaf spring is less than or equal to the length of the base slot. After the crystal head body has been inserted into the base slot, the leaf spring is disposed inside the base and thus is not exposed. Hence, space utilization rate of the crystal head body increases, and the positioning of the crystal head body is not compromised as a result of damage otherwise caused to the leaf spring, thereby preventing unauthorized persons from taking out the crystal head body and enhancing data security.

3 Claims, 3 Drawing Sheets

EMBEDDED SHORT LEAF-SPRING-EQUIPPED CRYSTAL HEAD AND EXTRACTOR THEREOF

BACKGROUND OF THE INVENTION

1. Technical Field

The present invention relates to the field of internet cable crystal heads and more particularly to an embedded short leaf-spring-equipped crystal head and an extractor thereof.

2. Description of Related Art

An internet cable crystal head, an important peripheral apparatus dedicated to network connection, is a connector which is plugged in a fixed direction, capable of preventing spontaneous disconnection, applicable to network-based communication, and for use in connecting with a network card port, a hub, a switchboard, or a phone. A leaf spring is disposed above a conventional crystal head. The crystal head is inserted into a base and thus fastened to the base by the leaf spring. The length of the leaf spring is configured to be larger than the depth of a base slot. It is easy for a user to pull out the crystal head by pressing the leaf spring.

However, a conventional crystal head has drawbacks as follows:

1. the leaf spring is exposed from the base and thus likely to be hit by any external object; as a result, the leaf spring is likely to sever and deform; and 2. the conventional crystal head in operation may be pulled out by any unauthorized person, thereby leading to data loss.

BRIEF SUMMARY OF THE INVENTION

In view of the aforesaid drawbacks of the prior art, it is an objective of the present invention to provide an embedded short leaf-spring-equipped crystal head and an extractor, characterized advantageously in that the embedded short leaf-spring-equipped crystal head cannot be pulled out by any unauthorized person, thereby preventing data loss.

In order to achieve the above and other objectives, the present invention provides an embedded short leaf-spring-equipped crystal head, comprising: a crystal head body insertable into a base slot of a base and a leaf spring disposed above the crystal head body to fasten the crystal head body to the base, characterized in that a length of the leaf spring is less than or equal to a length of the base slot.

A protrusion portion is disposed at an end portion of the leaf spring.

In order to achieve the above and other objectives, the present invention further provides an embedded short leaf-spring-equipped crystal head extractor, comprising a handle with a front end having an extraction bump corresponding in position to the leaf spring.

The front end of the extraction bump is of a smaller thickness than the rear end of the extraction bump.

The advantages of the present invention are described below. The length of the leaf spring is configured to be less than or equal to the length of the base slot. After the crystal head body has been inserted into the base slot of the base, the leaf spring is fully disposed inside the base and thus is not exposed; hence, not only does the space utilization rate of the crystal head body increase, but the positioning of the crystal head body is not compromised as a result of damage otherwise caused to the leaf spring. The crystal head body can only be taken out with a dedicated extractor, so as to prevent any unauthorized person from taking out the crystal head body, thereby enhancing data security.

DETAILED DESCRIPTION OF THE INVENTION

Figure 1:
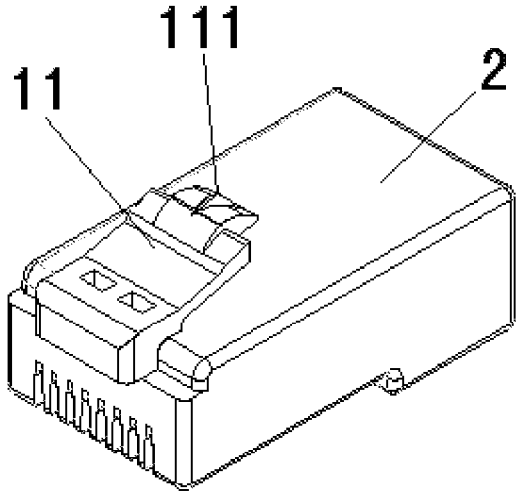
FIG. 1 is a perspective view of a crystal head body.
Figure 2:
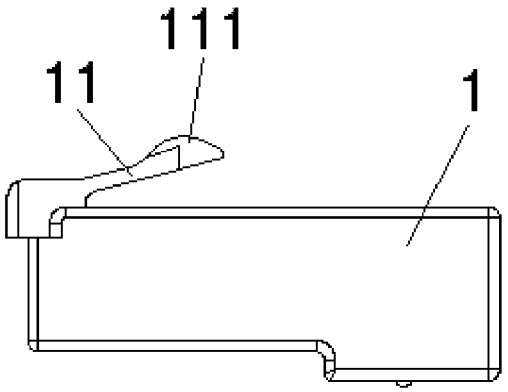
FIG. 2 is a schematic view of testing the crystal head body.

Referring to FIGS. 1-5, the present invention relates to an embedded short leaf-spring-equipped crystal head which comprises: a crystal head body 1 insertable into a base slot 21 of a base 2; and a leaf spring 11 disposed above the crystal head body 1 to fasten the crystal head body 1 to the base 2. The length of the leaf spring 11 is less than or equal to the length of the base slot 21.

Compared with the prior art, the present invention is characterized in that the length of the leaf spring 11 is configured to be less than or equal to the length of the base slot 21. After the crystal head body 1 has been inserted into the base slot 21 of the base 2, the leaf spring 11 is fully disposed inside the base 2 and thus is not exposed; hence, not only does the space utilization rate of the crystal head body 1 increase, but the positioning of the crystal head body 1 is not compromised as a result of damage otherwise caused to the leaf spring 11. A protrusion portion 111 is disposed at the end portion of the leaf spring 11. The leaf spring 11 extends upward obliquely in a direction opposite to a direction of the head body 1 being inserted into the base slot 21, and a top surface of the protrusion portion 111 is in contact with an inner surface of the base slot 21.

Since the protrusion portion 111 is disposed at the end portion of the leaf spring 11, the crystal head body 1 is fastened to the base slot 21 to thereby prevent disconnection of the crystal head body 1.

Figure 3:
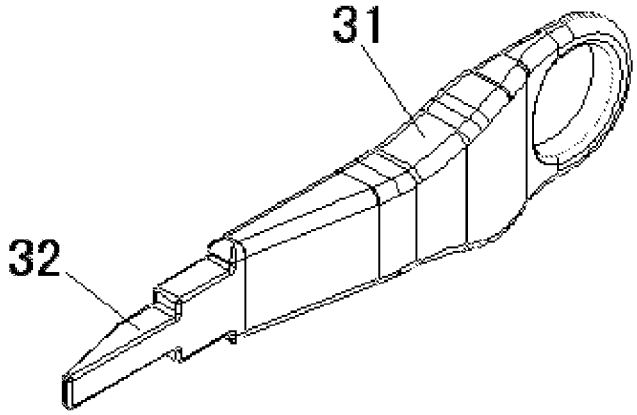
FIG. 3 is a perspective view of an extractor.

Referring to FIG. 3, an embedded short leaf-spring-equipped crystal head extractor comprises a handle 31. An extraction bump 32 is disposed at the front end of the handle 31 and corresponds in position to the leaf spring 11. The front end of the extraction bump 32 is of a smaller thickness than the rear end of the extraction bump 32.

Unlike its conventional counterparts, the crystal head body 1 of the present invention can only be taken out with a dedicated extractor, so as to prevent any unauthorized person from taking out the crystal head body 1, thereby enhancing data security.

Since the front end of the extraction bump 32 is of a smaller thickness than the rear end of the extraction bump 32, a user takes the crystal head body 1 out of the base 2 by inserting the extraction bump 32 into the base slot 21 of the base 2 to press the leaf spring 11 with the extraction bump 32.

The present invention is illustrated with a specific embodiment and further described below.

Figure 4:
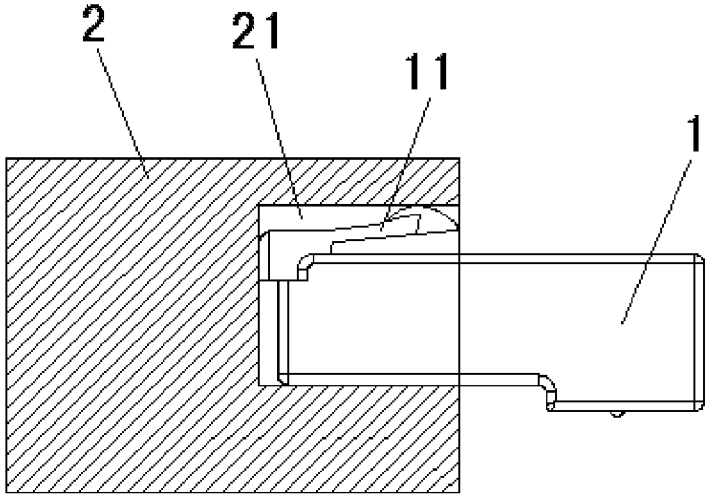
FIG. 4 is a schematic view of the crystal head body inserted into a base slot.

After the crystal head body 1 has been inserted into the base slot 21 of the base 2, the leaf spring 11 is fully disposed inside the base 2, and the protrusion portion 111 at one end of the leaf spring 11 fastens the crystal head body 1 to the base slot 21, as shown in FIG. 4.

Figure 5:
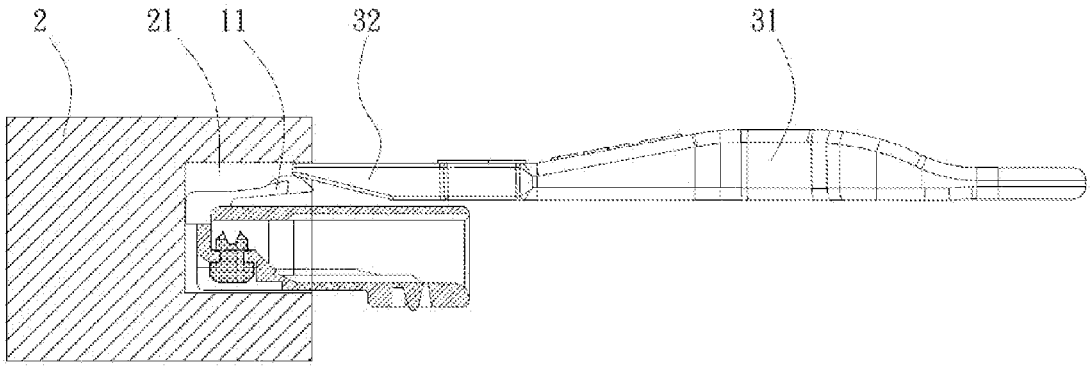
FIG. 5 is a schematic view of the crystal head body detached with the extractor.

To take out the crystal head body 1, the user inserts the extraction bump 32 of the extractor into the base slot 21 from above the leaf spring 11 to thereby press the leaf spring 11, as shown in FIG. 5.

Although the present invention is disclosed above by preferred embodiments, the embodiments are not restrictive of the present invention. Any persons skilled in the art can make various changes and modifications to the embodiments without departing from the spirit the present invention. Accordingly, the legal protection for the present invention should be defined by the appended claims.

What is claimed is:

1. An embedded short leaf-spring-equipped crystal head, comprising a crystal head body insertable into a base slot of a base and a leaf spring disposed above the crystal head body to fasten the crystal head body to the base, and a protrusion portion disposed at an end portion of the leaf spring, characterized in that a length of the leaf spring is less than or equal to a length of the base slot, so that the leaf spring is fully disposed inside the base slot and extends upward obliquely in a direction opposite to a direction of the head body being inserted into the base slot, and a top surface of the protrusion portion is in contact with an inner surface of the base slot.

2. The embedded short leaf-spring-equipped crystal head of claim 1, further comprising a handle with a front end having an extraction bump corresponding in position to the leaf spring so as to be inserted into the base slot in a direction same as the head body being inserted into the base slot to press the leaf spring so as to take the crystal head body out of the base.

3. The embedded short leaf-spring-equipped crystal head of claim 2, characterized in that a front end of the extraction bump is of a smaller thickness than a rear end of the extraction bump.

* * * * *